US005944647A

United States Patent [19]

Reynolds

[11] Patent Number: 5,944,647

[45] Date of Patent: Aug. 31, 1999

[54] MICROWAVE POPCORN BAG FOLDING METHODS TO ACCOMMODATE SMALL MICROWAVE OVENS

[76] Inventor: John A. Reynolds, 906 Breezemont Dr., Charleston, W. Va. 25302-3324

[21] Appl. No.: 08/869,836

[22] Filed: Jun. 5, 1997

[51] Int. Cl.[6] ..... B31F 1/00

[52] U.S. Cl. ..... 493/405; 493/408; 493/409; 493/421; 426/113; 426/234

[58] Field of Search ..... 493/405, 408, 493/409, 421; 83/82, 88; 426/243, 234, 113

[56] References Cited

U.S. PATENT DOCUMENTS

| | | | |
|---|---|---|---|
| 4,408,643 | 10/1983 | Laske et al. | 383/70 |
| 4,571,337 | 2/1986 | Cage et al. | 383/100 |
| 4,810,844 | 3/1989 | Anderson | 426/234 |
| 4,892,744 | 1/1990 | Ylvisaker | 383/100 |
| 5,076,556 | 12/1991 | Mandel | 493/421 |
| 5,078,509 | 1/1992 | Center et al. | 383/88 |
| 5,162,035 | 11/1992 | Baker | 493/405 |
| 5,171,594 | 12/1992 | Babbitt | 426/107 |
| 5,195,829 | 3/1993 | Watkins et al. | 383/100 |
| 5,200,590 | 4/1993 | Bowen et al. | 426/107 |
| 5,302,790 | 4/1994 | Turpin | 383/126 |
| 5,348,526 | 9/1994 | Feygin | 493/405 |
| 5,478,153 | 12/1995 | Feldkamper | 383/114 |
| 5,488,220 | 1/1996 | Freerks et al. | 426/107 |
| 5,690,853 | 11/1997 | Jackson et al. | 219/727 |

*Primary Examiner*—James F. Coan
*Assistant Examiner*—Gene L. Kim

[57] ABSTRACT

Folding methods were developed for a typical commercial microwave popcorn bag to control its linear expansion and enable it to remain centered in a small (less than one cubic foot) microwave oven with a rotating turntable while the bag is being expanded by the gases of the popping corn.

4 Claims, 1 Drawing Sheet

MICROWAVE POPCORN BAG FOLDING METHODS TO ACCOMMODATE SMALL MICROWAVE OVENS

CROSS REFERENCE TO RELATED APPLICATIONS

Not Applicable

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

This invention relates to folding methods applied to a typical commercial microwave popcorn bag, approximately 14 cm by 30.5 cm (5 ½ by 12 inches) when unfolded, to control linear expansion and permit better popping in a small microwave oven (less than 1 cubic foot capacity) having a rotating turntable.

A commercially available microwave popcorn bag, when popped in accordance with the instructions, will usually expand to a length larger than an interior dimension of the microwave oven, causing one of the outer flaps to strike one of the sides of the oven. The turntable then skews the bag off the center of the turntable, away from the centrally focused beams of the oven, resulting in less even heating and in less corn being popped. Also, the lower applied heat produces inferior, tougher popcorn. Thus, the current fabrication of commercial microwave popcorn bags doesn't properly accommodate the vast number of small microwave ovens that exist in the world today.

Folding methods were developed for a typical commercial microwave popcorn bag to retard its lateral expansion and enable it to remain centered in a small (one cubic foot or less) microwave oven while the bag is being expanded by the gases of the popping corn. This is particularly true for small microwave ovens having turntables, where the turntable tends to drag the bag off its central area if the unfolding bag flaps strike the oven wall. These methods consist of folding each outer flap of the bag (1 and 2 of FIG. 3) over on itself at least twice, and then against the central body as shown in FIG. 5; folding each flap over on itself multiple times, and against the central body, FIG. 9; folding the two corners diagonally in to the centerline of each of the two flaps, and folding them against the central body, FIG. 13, to retard the bag's lateral expansion during the popping process. The machinery to effect these folds is not a part of this invention.

BRIEF SUMMARY OF THE INVENTION

Folding methods were developed for commercial microwave popcorn bags to accommodate small microwave ovens of less than one cubic foot capacity. This method, consisting of one or more multiple folds of the outer flaps, enables the bag to unfurl as the gases of the popped corn expand it, without the outer flaps striking a vertical wall of the oven and forcing the bag off the center of the oven where the microwave beams are focused. This is particularly true for small microwave ovens with turntables, where the turntable tends to drag the bag off its center area if the bag strikes the oven wall.

BRIEF DESCRIPTION OF DRAWING FIGURES

FIGS. 1 through 4 illustrate a typical commercial microwave popcorn bag as it is opened by the expanding gases of the popped corn. FIG. 3 shows the condition when the outer flaps (Items 1 and 2) are extended fully outward from the main body, Item 3, but the vertical expansion of the bag has not progressed to a point of shortening the overall length. Thus, the diameter of the swept area by the rotating bag in the oven exceeds the distance between the opposite walls of the oven. FIGS. 5 through 8 portray the same bag, but with each of the outer flaps folded once over on itself to cause the swept area in the oven to be much less as the gas expansion occurs.

FIGS. 9 through 12 illustrate the initial bag, but with each of the outer flaps folded virtually an infinite number of times on itself so as to appear to be spiraled. These spiraled outer segments also unfurl more slowly with the expanding gases so they do not strike the walls of the oven. FIGS. 13 through 16 show the initial bag, but with the two corners of each flap folded inward to the centerline of each outer flap which reduces the diagonal length of the bag as the generated gases expand it, permitting the centrally focused microwaves to remain fixed on the popcorn in the central part of the bag.

DETAILED DESCRIPTION OF THE INVENTION

Figure 1:
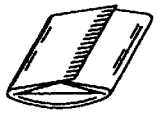
Figure 2:
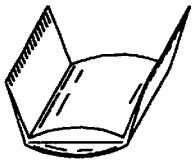
Figure 3:
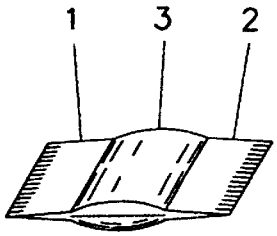
Figure 4:
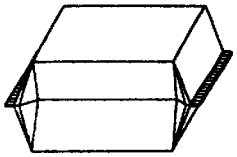
Figure 5:
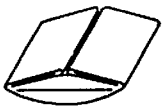
Figure 6:
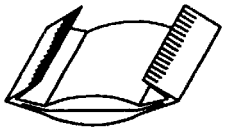
Figure 7:
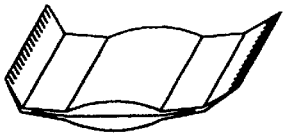
Figure 8:
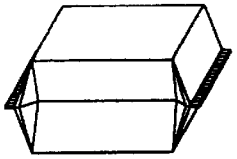
Figure 9:
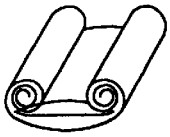
Figure 10:
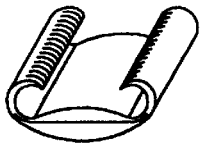
Figure 11:
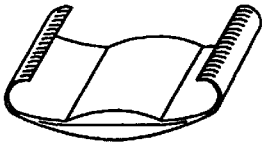
Figure 12:
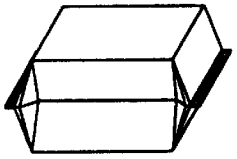
Figure 13:
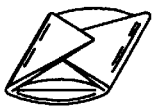
Figure 14:
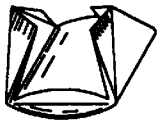
Figure 15:
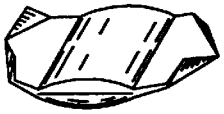
Figure 16:
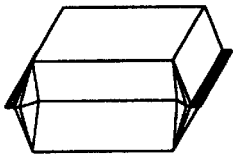

Folding methods were developed for a typical commercial microwave popcorn bag to retard its lateral expansion and enable it to remain centered in a small (less than one cubic foot) microwave oven while the bag is being expanded by the gases of the popping corn. This is particularly true for small microwave ovens having turntables, where the turntable tends to drag the bag off its central area if the expanding bag strikes the oven wall. These methods consist of folding each outer flap of the bag (1 and 2 of FIG. 3) over on itself at least once, and then against the central body as shown in FIG. 5; folding each flap over on itself multiple times, and against the central body, FIG. 9; folding the two corners diagonally in to the centerline of each of the two flaps, and folding them against the central body, FIG. 13, to retard the bag's unfolding during the popping process. The machinery to effect these folds is not a part of this invention.

I claim folding methods applied to a microwave popcorn bag as a means to control its linear expansion while used it a microwave oven which consists of:

1. A folding method applied to a microwave popcorn bag comprising, a central section filled with popcorn and cooking oil, having two opposed lateral flaps, and having the centerline along the long axis of the unfolded bag, with each flap having outer corners; said method consists of folding each of the said flaps as a means to expand said bag substantially only upward and to retard lateral expansion of the said flaps during a popping process in a microwave oven with interior walls whereby said lateral flaps do not strike the interior walls of a microwave oven of a dimension such that lateral expansion of a conventional microwave bag would strike the interior walls of a microwave.

2. A folding method applied to said bag in claim 1 consisting of folding each of the said flaps over on itself along the said centerline, which reduces its length and then folding each folded flap against the central section of said bag.

3. A folding method applied to said bag in claim 1 consisting of folding each of the said flaps over on itself many times to effect a spiral form against the central section of said bag.

4. A folding method applied to said bag in claim 1 consisting of folding said corners of each of the said flaps diagonally in to the said centerline, and then folding each folded flap against the central section of said bag.

* * * * *